United States Patent [19]

Provost

[11] Patent Number: 5,054,697

[45] **Date of Patent: * Oct. 8, 1991**

[54] REMOVABLE MILL THROAT AND WEAR RING FOR PULVERIZER

[76] Inventor: Robert S. Provost, Suite 283, 6393 Penn Ave., Pittsburgh, Pa. 15206

[ * ] Notice: The portion of the term of this patent subsequent to Oct. 17, 2006 has been disclaimed.

[21] Appl. No.: 459,430

[22] Filed: Jan. 2, 1990

[51] Int. Cl.[5] ..... B02C 15/06

[52] U.S. Cl. ..... 241/61; 241/119

[58] Field of Search ..... 241/117–121, 241/57, 300, 58, 60, 61

[56] References Cited

U.S. PATENT DOCUMENTS

| | | | |
|---|---|---|---|
| 4,721,258 | 1/1988 | Dougan et al. | 241/119 X |
| 4,874,135 | 10/1989 | Provost | 241/119 X |
| 4,907,751 | 3/1990 | Wark et al. | 241/119 |

*Primary Examiner*—Mark Rosenbaum
*Attorney, Agent, or Firm*—Olin E. Williams

[57] ABSTRACT

A coal pulverizer, that supplies a coal-in-air mixture to combustion means for a power plant and comprises grinding means consisting of wheels revolving in a power driven trough from which pulverized coal is centrifugally thrust into a stream of forced air blown upward through air passages in a throat ring consisting of uniformly sized segments, is provided with a wear ring of uniformly sized segments resting flush on the throat ring segments of equal arcuate dimension. Each said wear ring has a substantially trapezoidal cross section, the base of which rests on a throat ring segment, the vertical face of which fits against the inner wall of the pulverizer and the sloping face of which rises upward from its base at an angle measured from the vertical of between ten and seventeen degrees for approximately $2\frac{1}{2}$ and $3\frac{1}{2}$ inches, so as to deflect the coal-air stream away from direct impingement on the pulverizer housing. The provision of wear-ring segments of arcuate dimension the same as that of the underlying throat ring segments serves in novel manner to permit replacement of worn throat ring segments without the necessity of removing the grinding means from the pulverizer.

3 Claims, 2 Drawing Sheets

REMOVABLE MILL THROAT AND WEAR RING FOR PULVERIZER

This invention relates to improved coal pulverizers for coal-fired power plants.

The enormous quantities of fossil fuels required by modern industrial power plants has placed a heavy burden on that equipment which is designed to pulverize solid fuel, primarily coal and to supply it, dispersed in air, in substantially uniform size and at a uniform rate to the furnaces of such power plants. Recognizably, shut-downs for repair effect a costly burden that must ,whenever possible, be avoided.

Provost U.S. Pat. No. 4,874,135 teaches improvements in the mill throat rings in such pulverizers, which reduce air-compressor power requirements and "coal dribble", that is, the falling back of coal particles in the air channels of the throat ring. These throat rings are composed of uniformly sized arcuate segments, which assembled, form a ring surrounding the coal grinding mill of the pulverizer and provide a, plurality of air ducts which deliver forced air into contact with the coal particles to carry the same into classifier and combustion means of the power plant. Wear, or ledge cover, rings rest on the throat rings without blocking the outlets of the air channels and have been composed of segments of greater chord or arcuate, length than the throat ring segments so that fewer wear ring segments than throat ring segments have heretofore been employed in a single installation. This arrangement has however required the dismantling of the grinding wheels and truck assembly of the pulverizer to replace worn throat or wear rings; this dismantling at present adds to the operating costs as extended down-time and labor requirements.

It is therefore a primary object of this invention to reduce the costs of operating such coal pulverizers by reducing the dismantling required to replace the throat ring and wear ring segments.

It is another object of the invention to reduce the wear on the housing of the pulverizer.

SUMMARY OF THE INVENTION

It has been universal practice in the design and construction of coal pulverizers either to employ a unitary throat ring or, as in recent practice, to employ segments of the wear ring of arcuate lengths greater than the arcuate length of each segment of the throat ring. While the employment of segments of the throat ring rather than a unitary ring has greatly reduced the dismantling necessary to replace worn throat ring segments, the universal practice of employing wear ring segments of greater length than that of the throat ring segments has necessitated removing not only a worn throat ring segment and its associated, but longer, wear ring segment but also the grinding wheels and their truck assembly.

By fastening the wear ring segments to throat ring segments of equal arcuate dimension and, incidentally, providing a threaded throat bolt hole in the upper face of the wear ring segments to receive a ring bolt for lifting the segments, the removal of a worn throat ring segment or segments can be readily and inexpensively accomplished. The enormous wear created by handling a stream of coal of, for example, from 100,000 to 150,000 pounds per hour will eventually erode one or more segments, especially since coal fed to the grinding assembly is delivered in non-uniform amounts of non-uniform size distribution and thus effects non-uniform wear of the individual wear ring and throat ring segments.

The wear ring segments, of equal arcuate dimension to that of the throat ring segments, are of substantially trapezoidal cross-section (the sections actually deviating from trapezoidal only to the degree that one of the approximately parallel sides actually inclines inwardly from one to three and one half degrees from the horizontal). The trapezoidal configuration as hereinafter described, acts as a buffer to redirect the coal air-stream from direct impingement upon the inner housing of the pulverizer.

DETAILED DESCRIPTION OF THE DRAWINGS

Figure 1:
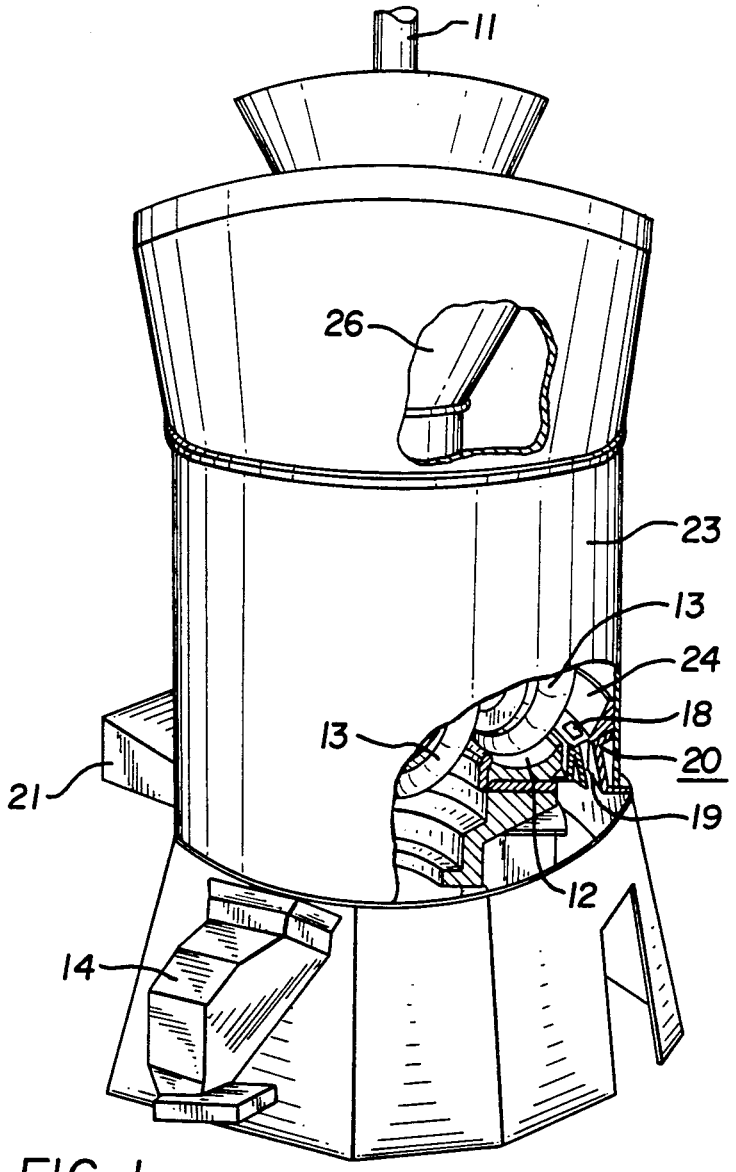
FIG. 1 is an elevational view in brief outline of a coal pulverizer with parts broken away to show the location of the throat ring and wear ring in relation to the coal grinder.

A coal pulverizer commonly employed in the power industry to grind coal and classify the product so as to deliver a substantially uniform flow of coal in air to a power plant is shown in outline in FIG. 1. On the exterior of the pulverizer is the delivery end 11 of coal conveying means 11 for the delivery of coal to the pulverizer and the means 21 for the supply of air from a compressor (not shown) into a lower section of the pulverizer. On the exterior of the pulverizer is a "pyrites box" 14 for receiving mineral particles separated from the ground coal in the pulverizer.

The lower broken away section of the pulverizer shows in cross section a portion of the trough-shaped grinding ring 12 which forms a revolving circular trough in which revolve grinding wheels 13. The grinding ring 12 is driven by a conventional drive mechanism (not shown). Pulverized coal is centrifugally cast by rapid revolution of the grinding ring 12 across the exit ports 18 of the air channels 19 of the throat ring 20 which circumscribes grinding ring 12. Superposed on the throat ring 20 is a wear ring 24, both of which are shown in more detail in subsequent Figures of the drawings. Forced air is supplied through air inlet 21 to and through the air channels 19 at such a rate of flow as to create an air-coal flow of between 1500 and 3000 pounds a minute. The forced air and the design of the air channels 19 (as hereinafter shown in detail) impart to the coal a swirling motion and carries the coal upward to the classifier and feeder pipes (not shown) rejected large sized coal particles fall through the classifier cone 26 from which they are discharged in known manner to the coal grinding assembly.

Figure 2:
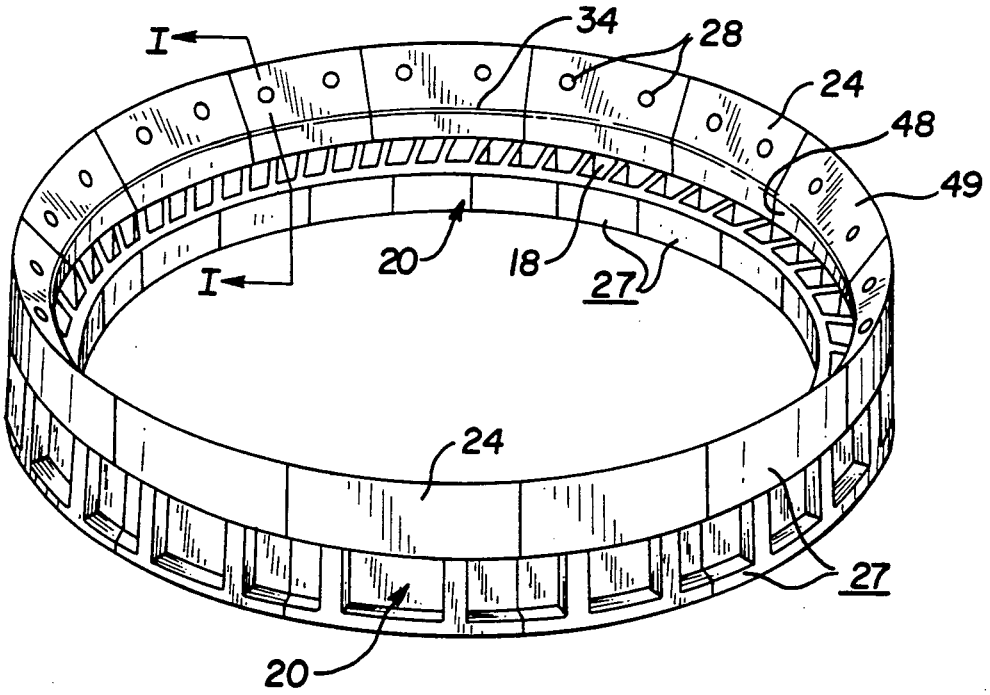
FIG. 2 is an elevational view of the throat ring and the superposed wear ring showing the segments consisting of equal arcuate sections of each ring.

Referring to FIG. 2, the throat ring 20 and superposed wear ring 24 consist of a plurality of regularly spaced arcuate segments 27, all of uniform arcuate dimension so that the throat ring and wear ring segments fit uniformly, the wear ring on top of the throat ring segments. The wear ring 24 covers only the outer rim of the throat ring so as to leave open exit ports 18.

Figure 3:
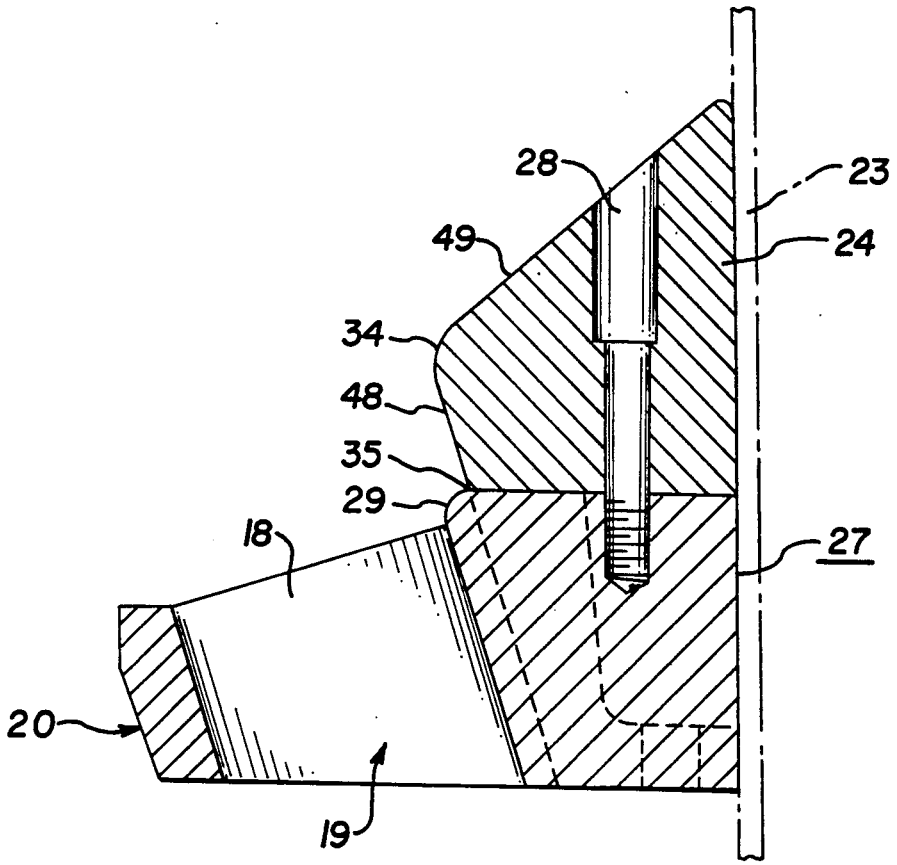
FIG. 3 is a vertical section through the rings showing the modified casting of the wear ring

FIG. 3 is a vertical section taken along line I—I of FIG. 2 at the center of the vertical axis of the bolt hole 28, in which a bolt, not shown, secures each wear ring segment to each throat ring segment in uniform alignment. As described in the U.S. Pat. No. 4,874,135, the air channels 19 lead to exit ports 18 across which coal is thrust and encounters a blast of air from the channels. The air stream is modified by arcuate bevel 29 and a corresponding restriction in the channel 19 so that the air blast encounters the coal stream at a modified angle partially concurrent with the coal stream; thus reducing coal dribble and the power otherwise required to propel the resultant coal-air mixture to the classifier section of the pulverizer.

The wear ring segments 27 are designed to prevent the coal particles in the coal-air stream from striking directly against the walls of the pulverizer housing immediately above the throat and wear rings. The wear ring is of substantially trapezoidal cross-section, has a sloping face 48 along which the thrust coal in air flows. This sloping face extends upwardly and inwardly from the throat ring at an inclination from the vertical of from ½ to 2 degrees and preferably at 1 degree. The inwardly sloping face 48 is from about 2 to 4 inches in height and preferably about 3 inches above the junction of the throat ring and the wear ring. The face of the wear ring segment above the inwardly sloping face 48 extends upward to the pulverizer housing. The inner face of the wear ring 48 serves to redirect the coal-air stream to a vertical direction and away from direct impingement on the said housing. The general configuration of the inner face of the wear ring, which can be termed an "ablative nose", thus gives an upward course to the coal-air stream oblique to the inner face of the pulverizer housing.

Contrary to the effect of the arcuate bevel of the throat ring described and claimed in Provost U.S. Pat. No. 4,874,135, which reduces the impact of forced air on the coal particles thrust from the grinding mechanism by directing the air more in the direction of the coal flow and serves to increase the rate of centrifugal flow of the coal stream, the ablative nose of the upwardly inclined face 4 of the wear ring of the present invention increases the impact of the coal-air stream on the wear ring and to a corresponding extent, decreases the impact of the stream on the inner face of the inner face of the pulverizer housing. The wear ring being of greater thickness at the major source of wear, provides an increasing life to the as a whole and is, moreover, susceptible to being protected by an abrasive resistant compound.

Figure 4:
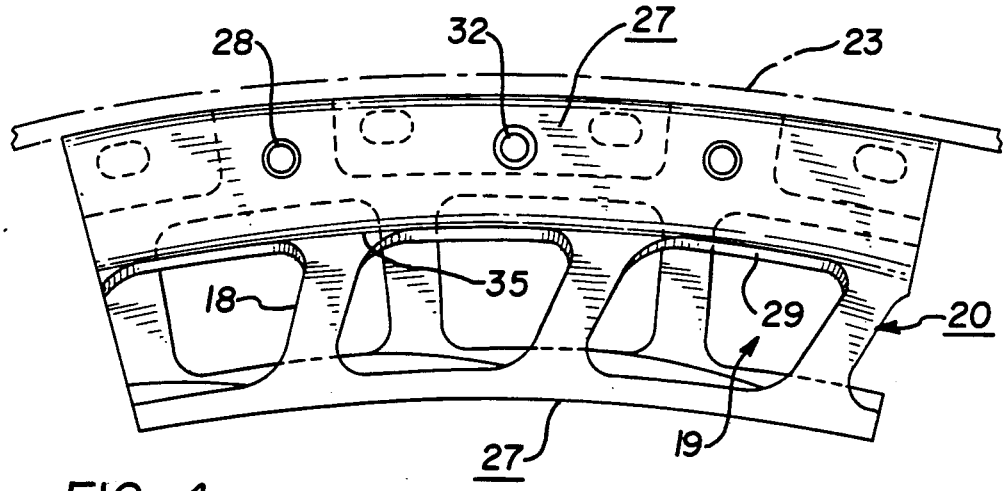
FIG. 4 is a plan view of a segment of the throat ring and the superposed wear ring segment.

FIG. 4 is a plan view of one segment of the throat ring 20 and one segment 27 of the superposed wear ring 24 showing in particular the conformation of the air channels of the throat ring, whereby an upward whirling motion is given to the compressed air and as a result to the coal-air stream. The inclined or sloping face 48, which provides protection of the housing 23 conforms at its lower edge with the outer arcuate convex edge of the throat ring along the line 35 as shown in the FIG. 4. The ablative nose 34 effects novel protection of the housing 23 from the abrasive action of the coal-air steam by redirecting the major force of the stream. Also shown are the bolts 28 holding the throat ring and the wear ring segments together as units of equal arcuate dimension, and of a deeply threaded bolt 32 (preferably by inserting a helical coil in the casting of the segment) so as to provide for insertion of a large ring bolt for lifting one wear ring segment from the pulverizer.

I claim:

1. In a coal pulverizer of generally cylindrical shape and vertical central axis and having 1) a mill assembly which thrusts pulverized coal centrifugally from the mill, and 2) a source of forced air directed into the so-thrust pulverized coal to transport the same upward to combustion means, apparatus comprising in combination: a radially segmented throat ring concentric to the mill, in which ring are angularly disposed channels through which the forced air is upwardly flowed, each said channel having an exit port of greater cross-section than that of the remainder of each corresponding channel, said port being formed by a convex outer diameter exit bevel coterminous with an upper surface of the throat ring; and a radially segmented wear ring encircling the mill assembly and disposed upon a radially outer surface of the throat ring clear of said exit ports, said wear ring having an inward inclined face extending upward from intersection with said throat ring, said face being disposed in substantial opposition to the resultant stream of forced air and pulverized coal dispersed therein, and an outward inclined face extending thereabove to the pulverizer housing.

2. The apparatus of claim 1 in which the inwardly inclined face extends upward at an angle to the vertical of between ½ and 2 degrees for between 1½ and 3 inches in height to intersection with an inclined plane extending outward therefrom to an inner wall of the housing of said pulverizer.

3. The apparatus of claim 1 in which the wear ring segments and throat ring segments are of equal arcuate dimension and rest radially flush, the wear ring upon the throat ring.

* * * * *